US009611007B1

(12) United States Patent
Fischer

(10) Patent No.: US 9,611,007 B1
(45) Date of Patent: Apr. 4, 2017

(54) WIDE BEAM, MULTI-HULL ICEBREAKER VESSEL

(71) Applicant: Bay Engineering, Inc., Sturgeon Bay, WI (US)

(72) Inventor: Joseph P. Fischer, Sturgeon Bay, WI (US)

(73) Assignee: Bay Engineering, Inc., Sturgeon Bay, WI (US)

( * ) Notice: Subject to any disclaimer, the term of this patent is extended or adjusted under 35 U.S.C. 154(b) by 0 days.

(21) Appl. No.: 15/131,169

(22) Filed: Apr. 18, 2016

(51) Int. Cl.
*B63B 1/12* (2006.01)
*B63B 35/08* (2006.01)

(52) U.S. Cl.
CPC ..... *B63B 1/12* (2013.01); *B63B 35/08* (2013.01)

(58) Field of Classification Search
CPC ..... B63B 1/12; B63B 35/08
USPC ..... 114/40
See application file for complete search history.

(56) References Cited

U.S. PATENT DOCUMENTS 3,754,523 A * 8/1973 Devine ..... B63B 35/08 114/271
3,768,427 A * 10/1973 Stephens ..... B63B 25/12 114/41
3,808,997 A * 5/1974 Bastian, Jr. ..... B63B 35/08 114/40
3,929,083 A * 12/1975 Blankenship ..... B63B 35/08 114/40
7,712,424 B2 * 5/2010 Madden ..... B63B 1/121 114/40

OTHER PUBLICATIONS

"The Ice Strengthened, Twin Hulled Susitna," MarineLink.com, Apr., 27, 2010, pp. 1-2, http://www.marinelink.com/news/article/the-ice-strengthened-twin-hulled-susitna/334071.aspx.
"M/V Susitna," Vigor.net, 2012, pp. 1-2, http://vigor.net/projects/project/m_v_susitna.

* cited by examiner

*Primary Examiner* — Lars A Olson
*Assistant Examiner* — Jovon Hayes
(74) *Attorney, Agent, or Firm* — Ziolkowski Patent Solutions Group, SC

(57) ABSTRACT

A wide beam, multi-hull icebreaker and method of operation thereof for opening a wide track through which large commercial vessels may traverse is disclosed. The icebreaker includes a plurality of hulls spaced apart and arranged generally in parallel to one another, with each of the hulls including a bow thereon configured to break through a sheet of ice through which the icebreaker traverses. The spaced apart hulls define at least one channel therebetween into which ice broken by the hulls is routed, and the hulls are spaced apart a distance such that a beam of the icebreaker is as wide as a beam of a commercial vessel it is servicing. A conveyor system may be included on the icebreaker that removes broken ice from the channel(s) between the hulls and casts it to the side of the track to leave a less dense track of broken ice.

22 Claims, 11 Drawing Sheets

WIDE BEAM, MULTI-HULL ICEBREAKER VESSEL

BACKGROUND OF THE INVENTION

Embodiments of the invention relate generally to the arrangement of icebreaker vessels and, in particular, to a wide beam, multi-hull icebreaker designed to open a wide track through which large commercial vessels may traverse and with an open space between the hulls through which broken ice is funneled and may be removed to keep the track clear.

Icebreaker vessels, or "icebreakers" are designed to assist large commercial vessels in winter traffic. Such assistance includes opening or maintaining passages through ice fields and ice covered waters, as while large commercial vessels are locally reinforced to operate in broken ice, the wide beam hull form and low propulsion power of typical large commercial vessels make them unsuitable to break ice. In normal operation, an icebreaker leads the way through the ice field with the commercial vessels following, single file, in the track of the icebreaker.

The design of icebreakers has changed and improved over the decades but has always retained common structural characteristics. In general, conventional icebreakers incorporate a section at the bow that differs from the typical deep V-shaped or U-shaped sections for non-icebreaking ships by reason of a cutaway bow that can ride up on top of the ice and break the ice because of its weight. Additionally, the conventional icebreakers are mono hulls designed and built to normal commercial vessel proportions regarding the beam-to-draft and length-to-beam ratios, as a wide beam monohull would require higher than normal power to break ice, have unfavorable propulsion characteristics in open water, and result in a shallow draft hull form—with it being recognized that sufficient draft is required to submerge the propeller(s) of the icebreaker and that the higher power required to break ice in a wide beam monohull would lower the efficiency thereof as propulsion efficiency is better with larger diameter, slower turning propellers as compared to smaller diameter, faster turning propellers.

While conventional icebreaker designs are suitable for opening tracks of sufficient size and quality for allowing commercial vessels to follow therethrough, it is recognized that certain drawbacks and limitations are associated with conventional icebreaker designs. First, it is recognized that the size of commercial vessels has increased dramatically in the last 50 plus years, such that the current monohull icebreaker leaves a much narrower track than these wide commercial vessels—thereby causing the "shoulder," or full beam at the bow, to strike unbroken ice which impedes their progress and may cause structural damage. Second, it is recognized that the monohull design of conventional icebreakers results in the ice being broken thereby remaining in the track that is formed. The broken ice in the track loses its insulating snow cover and re-freezes rapidly making it difficult to maintain a track and, in certain weather conditions, the broken ice can form into small particles with little entrained water between the particles so as to form what is called "slush ice." Slush ice is not solid but can become thick at certain conditions and at certain locations (e.g., at the entrance of a river), and the slush ice adds friction to the hull of the commercial vessels, impeding or stopping their progress. The slush ice can also clog the water inlet (sea chest) of the vessels causing the propulsion engines of the vessel to shut down for lack of cooling water.

Therefore, it is desirable to provide an icebreaker that is capable of opening a track of sufficient width to accommodate commercial vessels of increased size and width. It is further desirable for such an icebreaker to provide for the partial removal of broken ice and slush ice from the track that is formed in order to more easily keep the track open and reduce the amount of such broken/slush ice in order to reduce friction on the hull and prevent potential clogging of the water inlet of the vessel.

BRIEF DESCRIPTION OF THE INVENTION

In accordance with one aspect of the invention, a wide beam, multi-hull icebreaker includes a plurality of hulls spaced apart and arranged generally in parallel to one another and a bridging structure connecting the plurality of hulls. Each of the plurality of hulls includes a bow thereon configured to break through a sheet of ice through which the wide beam, multi-hull icebreaker traverses. The plurality of spaced apart hulls define at least one channel therebetween into which at least of portion of ice broken by the hulls is routed, and the plurality of hulls are spaced apart a distance such that a beam of the wide beam, multi-hull icebreaker is as wide as a beam of a commercial vessel it is servicing.

In accordance with another aspect of the invention, a wide beam, multi-hull icebreaker includes a plurality of hulls spaced apart and arranged generally in parallel to one another and a bridging structure connecting the plurality of hulls. Each of the plurality of hulls includes a bow thereon configured to break through a sheet of ice through which the wide beam, multi-hull icebreaker traverses, and the plurality of spaced apart hulls define at least one channel therebetween into which at least of portion of ice broken by the hulls is routed. The wide beam, multi-hull icebreaker also includes a conveyor system positioned and configured to remove ice from the at least one channel and convey it to a region outside of a track in the ice formed by the wide beam, multi-hull icebreaker.

In accordance with yet another aspect of the invention, a method of assisting a wide beam vessel through an ice field includes providing a wide-beam, multi-hull icebreaker having a plurality of hulls spaced apart and arranged generally in parallel to one another, each of the plurality of hulls comprising a bow thereon configured to break through a sheet of ice through which the wide beam, multi-hull icebreaker traverses, wherein the plurality of spaced apart hulls define at least one channel therebetween. The method also includes advancing the wide-beam, multi-hull icebreaker through the ice field to form a track of broken ice in the ice field through which the wide beam vessel can pass, with the plurality of hulls being spaced apart a distance such that a beam of the wide beam, multi-hull icebreaker is as wide as a beam of the wide beam vessel it is assisting, such that a width of the track of broken ice in the ice field is essentially the same width as the wide beam vessel.

Various other features and advantages will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Figure 1:
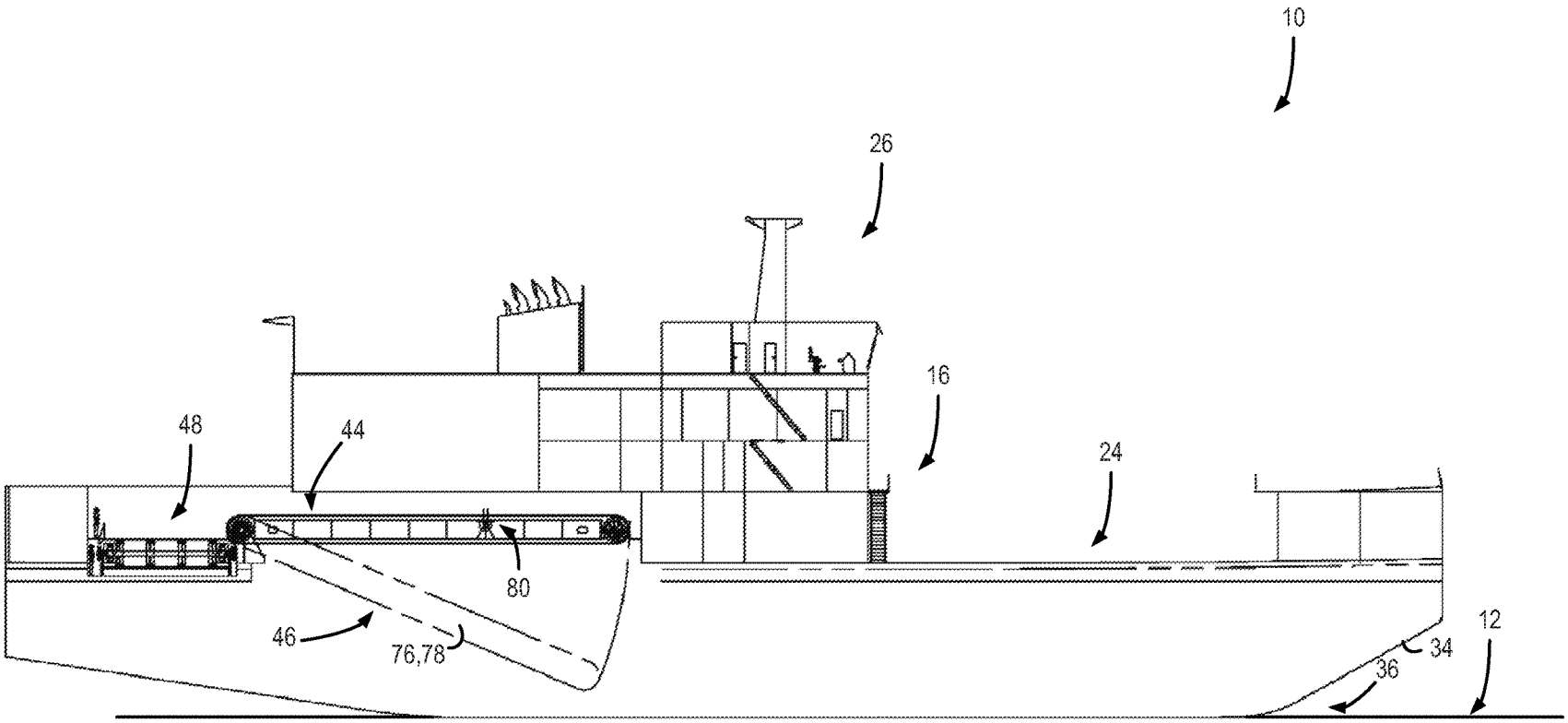
FIG. 1 is a side view of a catamaran-type wide beam, multi-hull icebreaker vessel, according to an embodiment of the invention.

Embodiments of the invention provide a wide beam, multi-hull icebreaker designed to open a wide track through which large commercial vessels may traverse and with an open space between the hulls through which broken ice and slush ice is removed to reduce the amount of broken ice remaining in the track. In an optional and exemplary embodiment of the invention, a conveyor system is included on the icebreaker that removes broken ice and slush ice from the open space between the hulls and casts it to the side of the track, so as to leave a less dense track of broken ice that is easier to maintain.

Referring to FIGS. 1-4, a wide beam, multi-hull icebreaker vessel 10 is illustrated according to an embodiment of the invention. The icebreaker vessel 10 is constructed to make a wide track of broken ice through a surrounding ice layer or ice field 12. In general, the icebreaker includes a pair of hulls 14, a bridging structure 16 joining the hulls, and one or more propellers 18—with the pair of hulls 14 providing a catamaran hull type construction for the icebreaker 10. It is recognized that the icebreaker 10 may incorporate numerous features and elements standard to such vessels as well as other features and elements that enable the vessel to be multi-functional and perform other tasks beyond simply an ice breaking function—including ATON (buoy tending), oil spill recovery, SAR (Search and Rescue) and serving as a Disaster Command Center. Accordingly, the icebreaker may include a main deck 24 (as part of bridging structure 16), as well as features such as a heliport/helipad, storage compartments, ballast tanks, equipment areas, cabins, galley, a chartroom, and the like.

Figure 2:
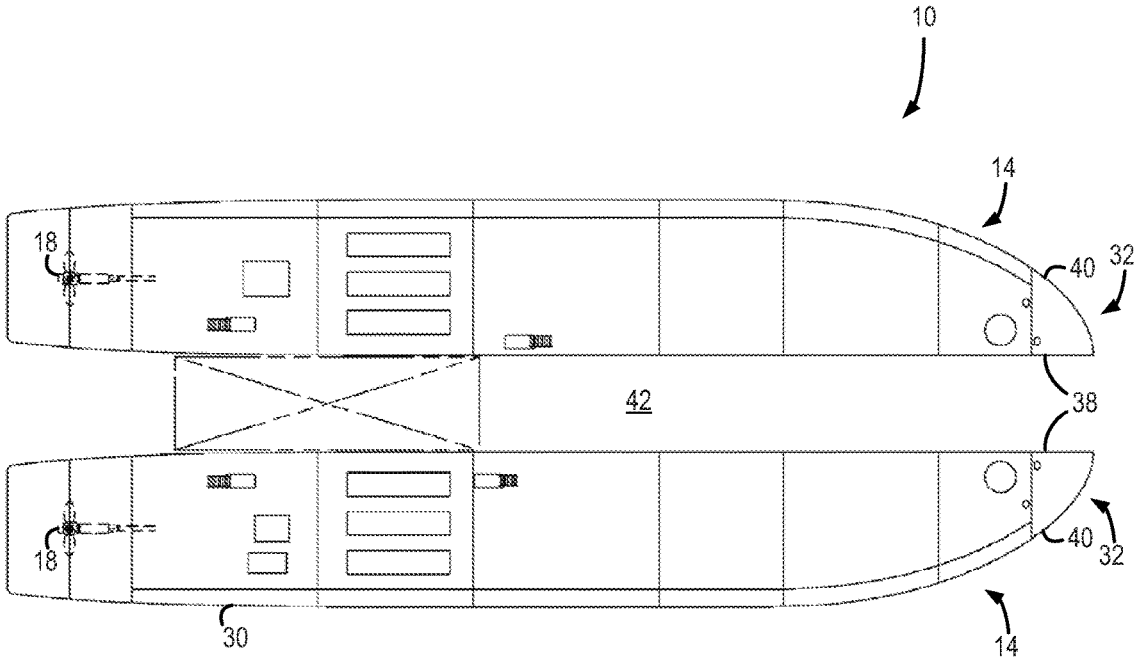
FIG. 2 is a plan view of the bottom (lower deck) of the wide beam, multi-hull icebreaker vessel of FIG. 1.
Figure 3:
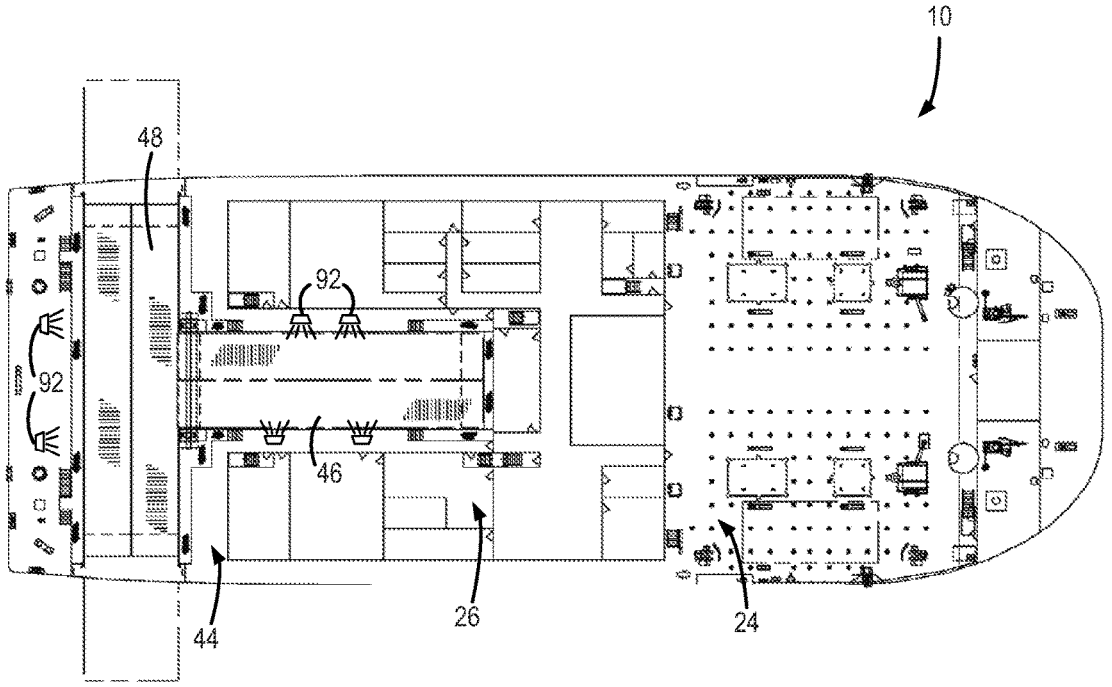
FIG. 3 is a plan view of the main deck of the wide beam, multi-hull icebreaker vessel of FIG. 1.
Figure 4:
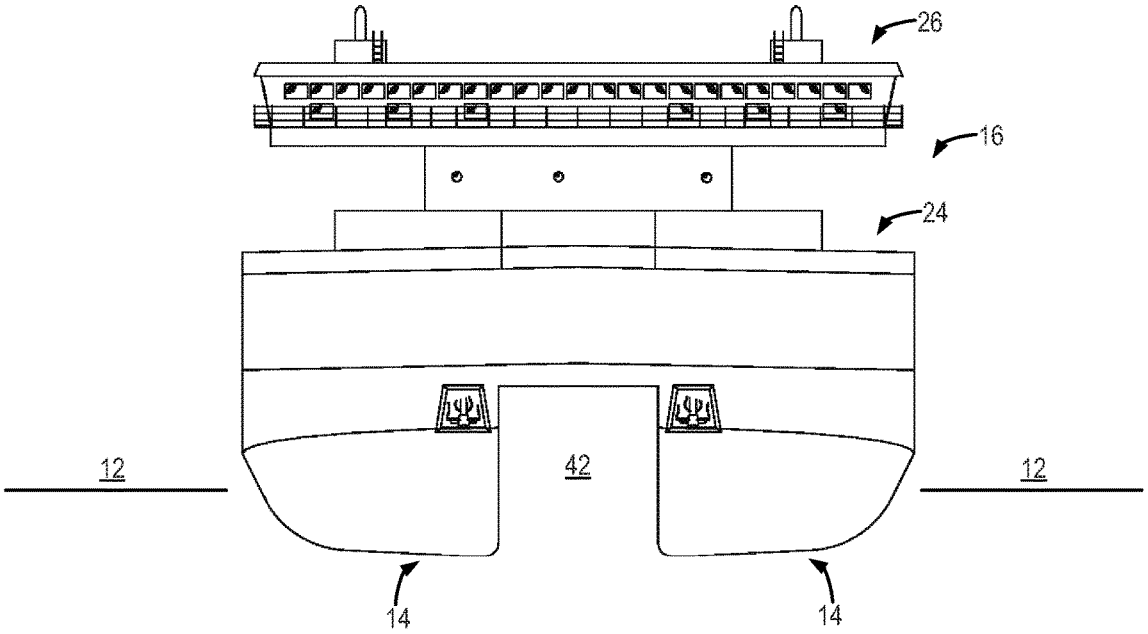
FIG. 4 is a front view of the wide beam, multi-hull icebreaker vessel of FIG. 1.
Figure 17:
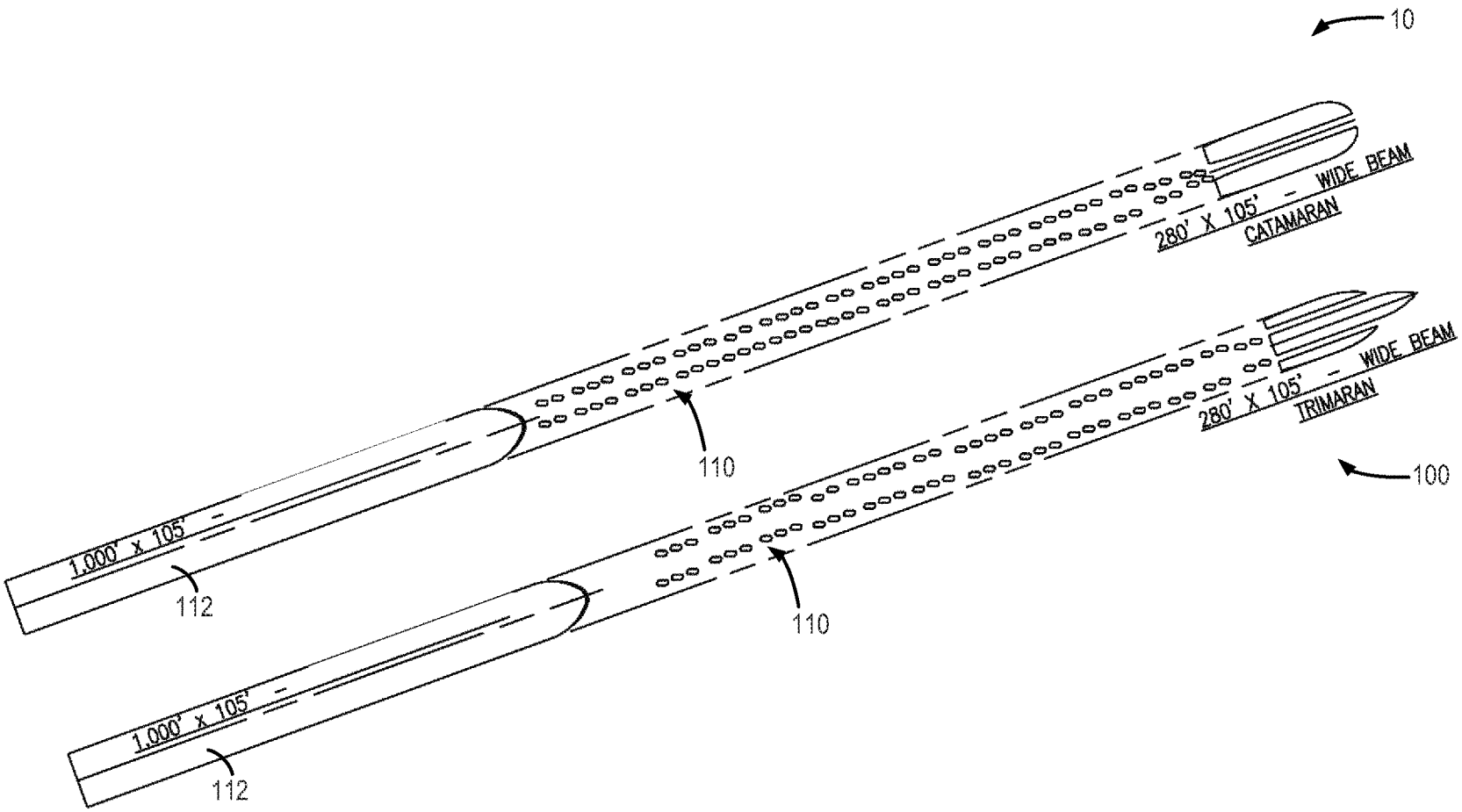
FIG. 17 illustrates a track formed by the catamaran-type and trimaran-type wide beam, multi-hull icebreaker vessels of FIGS. 1 and 9 relative to a commercial vessel being serviced.

As best shown in FIGS. 2-4, the multi-hull icebreaker 10 is constructed such that the hulls 14 are spaced apart a distance that provides a beam 28 of the icebreaker 10 that is as wide as the beam of a large, state-of-the-art commercial vessel it is servicing (see FIG. 17). According to an exemplary embodiment, the hulls 14 are spaced apart a distance such that the beam 28 of icebreaker 10 is approximately 105 feet (with a length of the icebreaker 10 being 280 feet, for example)—with the beam 28 of the icebreaker 10 thus being of comparable size to the beam of the commercial vessel it is servicing, with such commercial vessels being constructed to have a beam 105 feet in size and a length of up to 1,000 feet. Accordingly, the wide-beam, multi-hull icebreaker 10 is constructed to make a track of sufficient width to accommodate commercial vessels of increased size and width.

As shown in FIG. 2, each hull 14 of icebreaker 10 has sides 30 and a sloped bow portion 32 with a stem line 34 (FIG. 1). The bow 32 may function to break the ice layer 12 in a conventional manner by riding up on the ice and breaking it via the weight of the vessel 10 pushing down thereon, and the bow 32 and stem line 34 may also include conventional features such as a stem bar and notch (or "ice knife) that enhance the ice breaking capability of the vessel—with it being recognized that the exact hull form utilized for ice breaking may vary according to various embodiments of the invention.

According to an exemplary embodiment, the bow 32 of each catamaran hull is an asymmetric bow having an inboard side 38 and an outboard side 40. The outboard side 40 of the bow 32 on each hull 14 is curved such that ice pushed down by the stem line 34 of the hull 14 is caused to slide along the sloped bow to the bottom. The inboard side 38 of the bow 32 on each hull 14 is formed as a straight side, such that inboard sides 38 of the bows 32 on the two hulls 14 are parallel to one another. The forming and arranging of the inboard sides 38 as straight and parallel sides prevents increased ice loads on each inboard side 38, which would occur if broken ice were funneled into the channel 42 between the hulls 14, thereby preventing an unmanageable build-up of broken ice within the channel 42.

In an exemplary embodiment, a conveyor system 44 is also included on the multi-hull icebreaker 10 is that is positioned and configured to provide for removal of broken ice that enters into the channel 42 between hulls 14—with the conveyor system 44 functioning to remove at least a portion of the broken ice from the channel 42 and transfer the broken ice to a region outside of the track formed by the multi-hull icebreaker 10. As best shown in FIG. 3, the conveyor system 44 includes a longitudinal conveyor 46 that is positioned within channel 42 and a horizontal conveyor ("shuttle conveyor") 48 oriented transverse to the longitudinal conveyor 46 and positioned adjacent aft of the longitudinal conveyor. As can be seen in FIG. 1, the longitudinal conveyor 46 is pivotable between a generally horizontal stowed position and an angled position—with the longitudinal conveyor 46 being positioned so as to be above the water line 36 when in the generally horizontal stowed position and the longitudinal conveyor 46 being positioned to angle downward from the bridging structure 16 into and below the water line 36 when in the angled position, such that broken ice may be guided onto the longitudinal conveyor 46. The shuttle conveyor 48 may, in an exemplary embodiment, be positioned 24 at the end of the longitudinal conveyor 46 opposite the end that is lowered into the water, with the shuttle conveyor 48 extending out transverse from the longitudinal conveyor 46 in either direction and extending out from the side 30 of the icebreaker 10 to cast the ice outward off the side(s) of the icebreaker. In this manner, broken ice that enters into channel 42 between hulls 14 may be removed from the channel and transferred to a region outside of the track in the ice formed by the multi-hull icebreaker 10 via the conveyor system 44.

Figure 5:
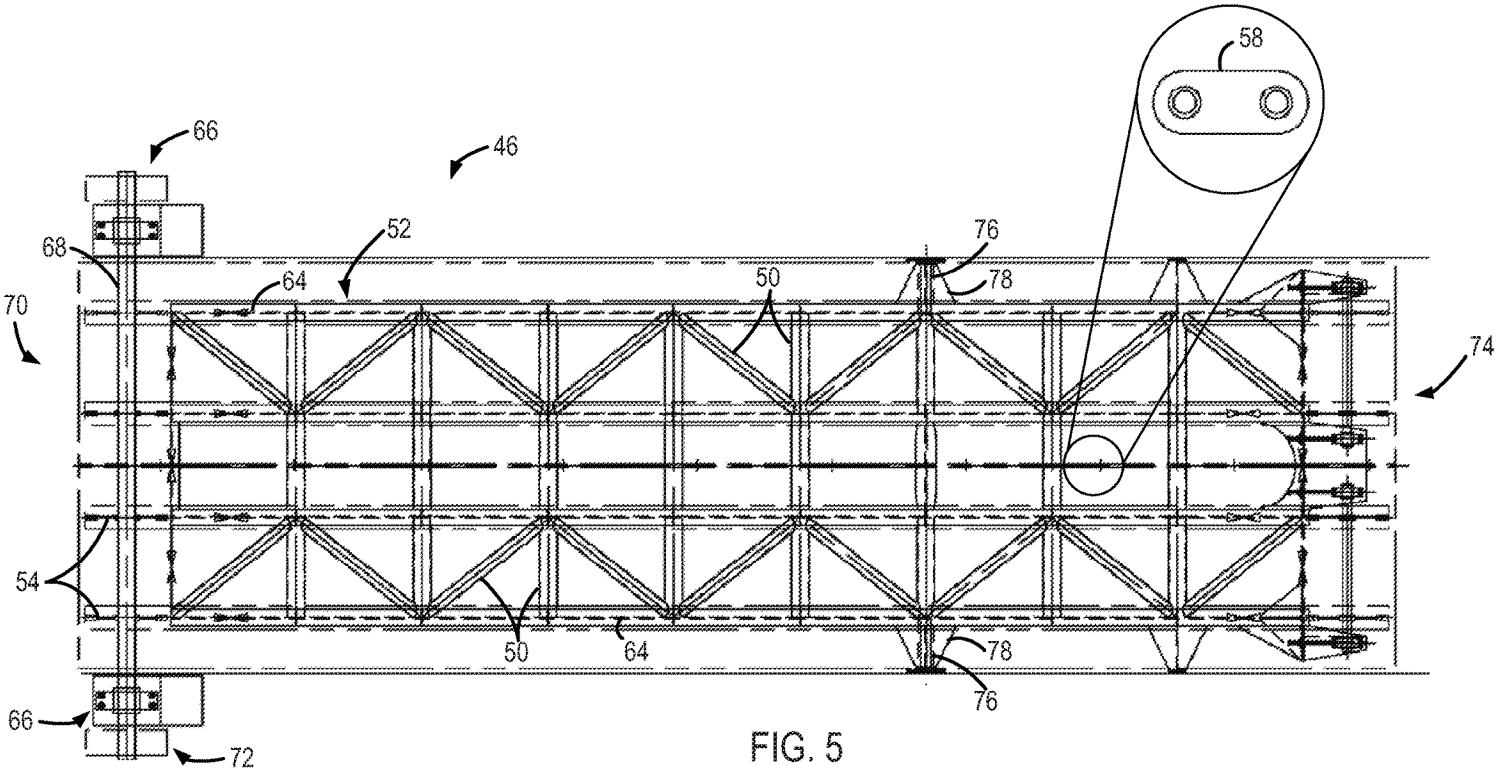
FIGS. 5 and 6 are top and side views of a longitudinal conveyor included in the wide beam, multi-hull icebreaker vessel of FIG. 1.
Figure 6:
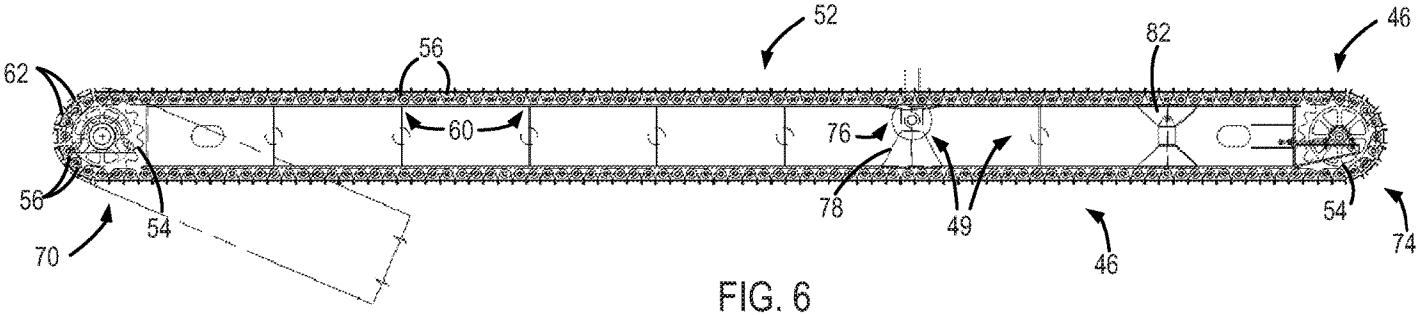

Referring now to FIGS. 5 and 6, the longitudinal conveyor 46 is shown in greater detail according to an exemplary embodiment thereof. The longitudinal conveyor 46 is constructed to include an internal open support structure 49 that supports moving transverse metal beams or shapes 50 that form a "belt" 52 to convey the broken ice thereon. The internal open support structure 49 has metal sprockets 54 at each end that engage shafts or pins 56 which are used to pin connecting links 58 on the transverse beams 50 together. Brackets 60 are attached to the underside of each transverse beam 50 for mounting the connecting links 58 which are pinned together. By proper spacing of the brackets 60, the pin 56 provides a lug 62 that is engaged by the sprockets 54 at each end. On the upper load carrying side of the conveyor belt 52, the connecting links 58 are supported by a longitudinal beams 64 being part of the conveyor support structure 49 and that include a flange thereon. The connecting links 58 can slide on anti-friction material, such as ultra-high-molecular-weight polyethylene (UHMWPE), on the beams 64 or can be supported by rollers on the links 58 that ride on the beams 64. The brackets 60 on the underside of the conveyor belt 52 hang from the flange of the longitudinal beams 64, with the brackets 60 sliding on the flange or having rollers to ride on the flange of the longitudinal beams.

As shown in FIG. 5, at least one end of the longitudinal conveyor 46 has the sprockets 54 driven and the other end may be driven or be idlers. Shafts 68 extending outward from the conveyor belt 52 to attach the drive unit 66 to the sprockets 54. While the drive unit 66 is illustrated in FIG. 5 as a dual drive unit (a drive on each side of the conveyor belt 52), it is recognized that the drive unit 66 could instead be a single unit on one side. The drive unit 66 may be provided as a hydraulic motor attached to the drive shaft 68 or can be provided as a reduction gear and electric motor attached to the drive shaft 68. Accordingly, the drive unit 66 can have a variable frequency control or have a synchronous electric motor connected to a fluid coupling (hydraulic transfer of torque) or both—such that the conveyor belt 52 can have a fixed or variable speed. According to an exemplary embodiment, the drive unit 66 operates the longitudinal conveyor such that a minimum speed of the conveyor belt 52 is equal to a speed of the icebreaker 10 divided by the cosine of the angle of the inclined conveyor belt 52 from the horizontal. Operating at such a minimum speed ensures that the longitudinal conveyor 46 is moving at a speed sufficient to convey and remove broken ice that is being moved/forced onto the conveyor belt 52 as the icebreaker 10 traverses through an ice field, so as to prevent a build-up of broken ice on the conveyor belt 52 that could overload the longitudinal conveyor 46.

As indicated previously above, longitudinal conveyor 46 is pivotable between a generally horizontal stowed position and an angled position—with the longitudinal conveyor 46 being normally positioned so as to be above the water line 36 when in the generally horizontal stowed position (so as to be accessible for maintenance and repair) and the longitudinal conveyor 46 being positioned to angle downward from the bridging structure 16 into and below the water line 36 when in the angled position. To provide for such rotation, an aft or first end 70 of the longitudinal conveyor 46 pivots on bearings 72 fixed to the bridging structure 16 of the icebreaker, such as to the deck 24. A forward or second end 74 of the longitudinal conveyor 46 is suspended by a pivot 76 at each side of the conveyor belt 52 that is connected to rigging 78 that connects to an actuating system 80 (FIG. 1), such as a wire rope and topping winch or hydraulic cylinder(s), that provides for lowering of the second end into the water below the broken ice and also raising of the second end back to the stowed position. For retaining the longitudinal conveyor 46 in the stowed position, a fixed structural stop 82 is provided on support structure 49 that may be coupled with the bridging structure 16 to support the second end and relieve the load from the actuating system 80.

Figure 7:
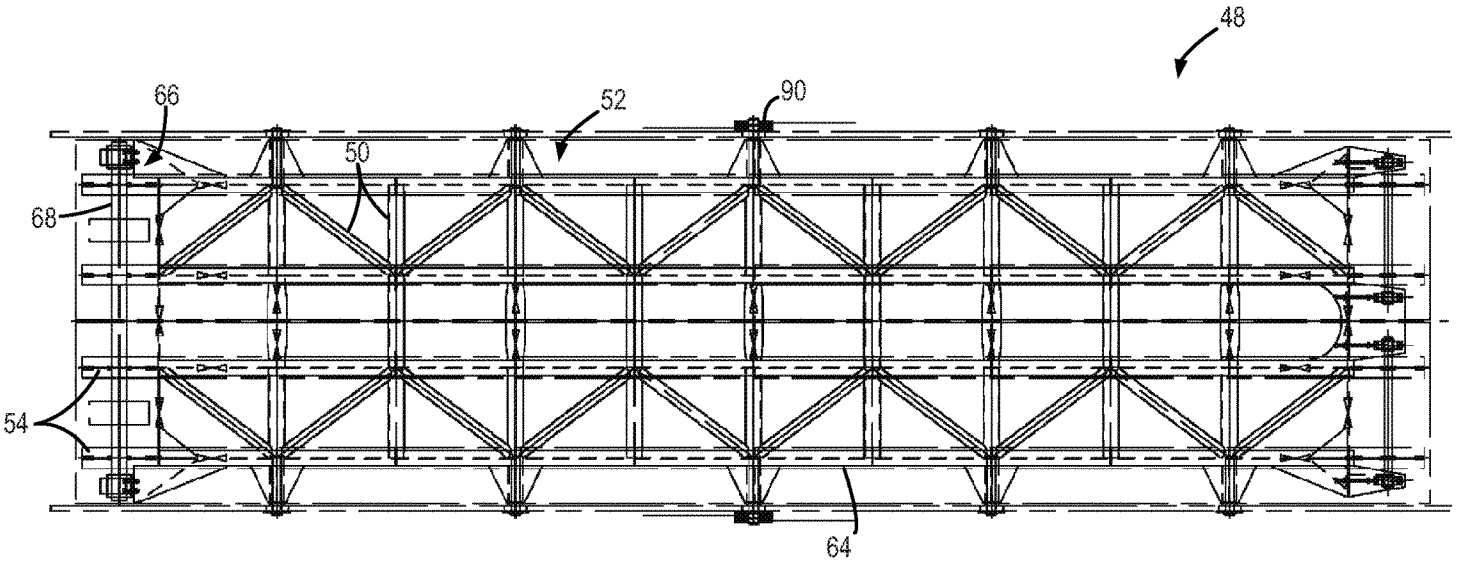
FIGS. 7 and 8 are top and side views of a shuttle conveyor included in the wide beam, multi-hull icebreaker vessel of FIG. 1.
Figure 8:
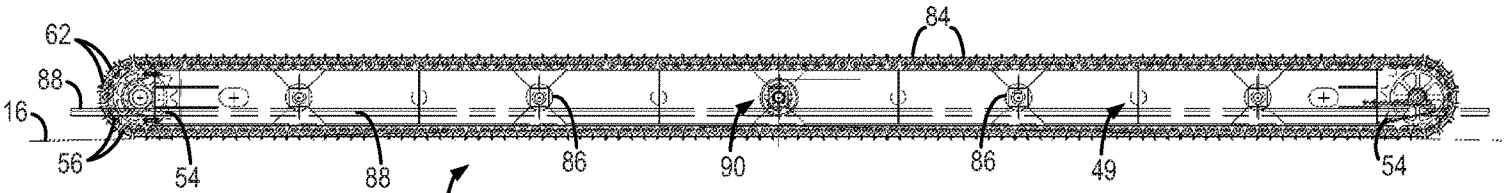

Referring now to FIGS. 7 and 8, the shuttle conveyor 48 is shown in greater detail according to an exemplary embodiment thereof. The shuttle conveyor 48 is similar to the longitudinal conveyor 46 in construction in that it includes internal open support structure 49, transverse beams 50 that form a "belt" 52, metal sprockets 54, pins 56, connecting links 58, brackets 60, lugs 62, longitudinal beams 64 and drive unit 66, and thus will not be described in great detail herein. In addition to the above components, the shuttle conveyor 48 also includes fixed skirts 84 above the conveyor belt 52 to contain the ice thereon. The main support structure 49 has beams cantilevered with rollers 86 on a fixed rail 88 that is attached to the vessel's structure 16. The shuttle conveyor 48 is stowed within the beam 14 of the icebreaker vessel 10 (see FIG. 3) and can be traversed out to either side 30 of the vessel by a translation mechanism 90, such as a wire rope and winch or hydraulic cylinder(s). For a catamaran hull, both the translation mechanism 90 and the conveyor drive unit 66 are reversible so as to cast the ice to either side of the icebreaker 10—with a speed of the horizontal shuttle conveyor 48 being fast enough to carry away the volume of ice that is discharged from the inclined longitudinal conveyor 46.

In an exemplary embodiment, and as best shown in FIG. 3, a system of fixed and portable hot water or steam nozzles 92 may be positioned adjacent the longitudinal conveyor 46 and shuttle conveyor 48 in order to wash down the conveyor system 44 so as to prevent excessive buildup of ice on the conveyor belts 52 in freezing temperatures. Water generated by the ice melted by hot water/steam nozzles 92 is gravity drained to the open channel 42 between the hulls 14 or outboard off the sides 30 of icebreaker 10.

Referring now to FIGS. 9-12, a wide beam, multi-hull icebreaker vessel 100 constructed to make a track of broken ice through a surrounding ice layer or ice field 12 is illustrated according to another embodiment of the invention. In general, the icebreaker 100 includes three hulls 14, a bridging structure 16 joining the hulls, and one or more propellers 18 (e.g., three propellers, one on each hull)—with the three hulls 14 including an inner hull 102 and two outer hulls 104 that provide a trimaran hull type construction for the icebreaker 100.

Figure 10:
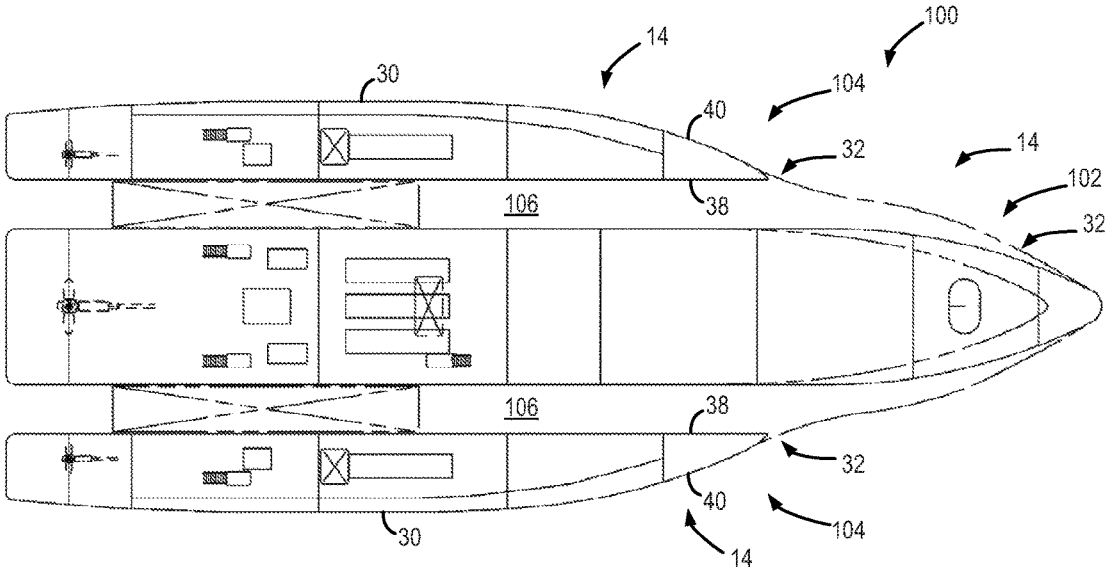
FIG. 10 is a plan view of the bottom (lower deck) of the wide beam, multi-hull icebreaker vessel of FIG. 9.
Figure 11:
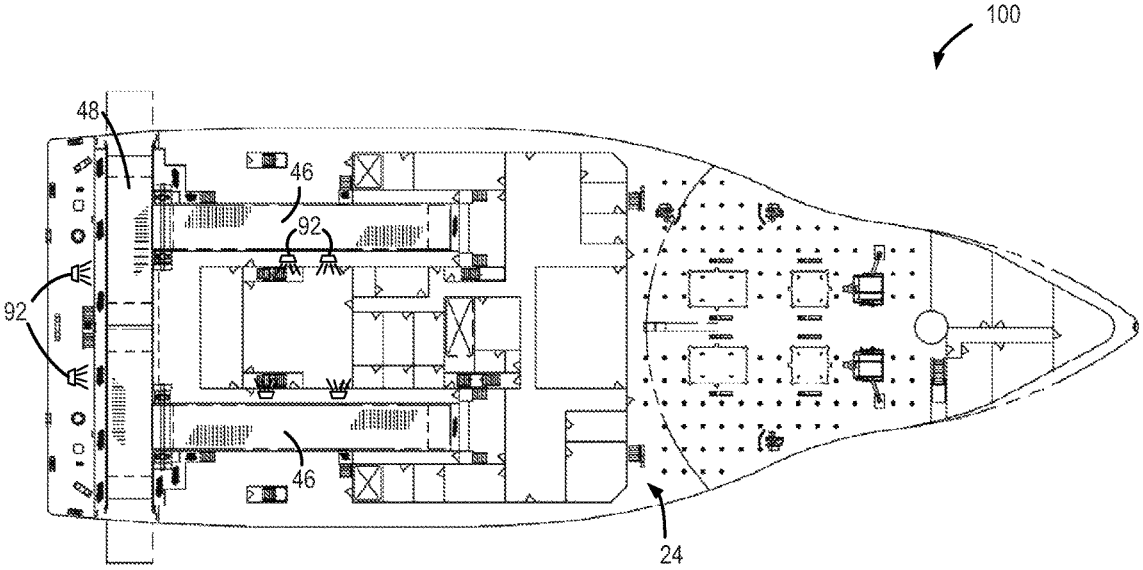
FIG. 11 is a plan view of the main deck of the wide beam, multi-hull icebreaker vessel of FIG. 9.
Figure 12:
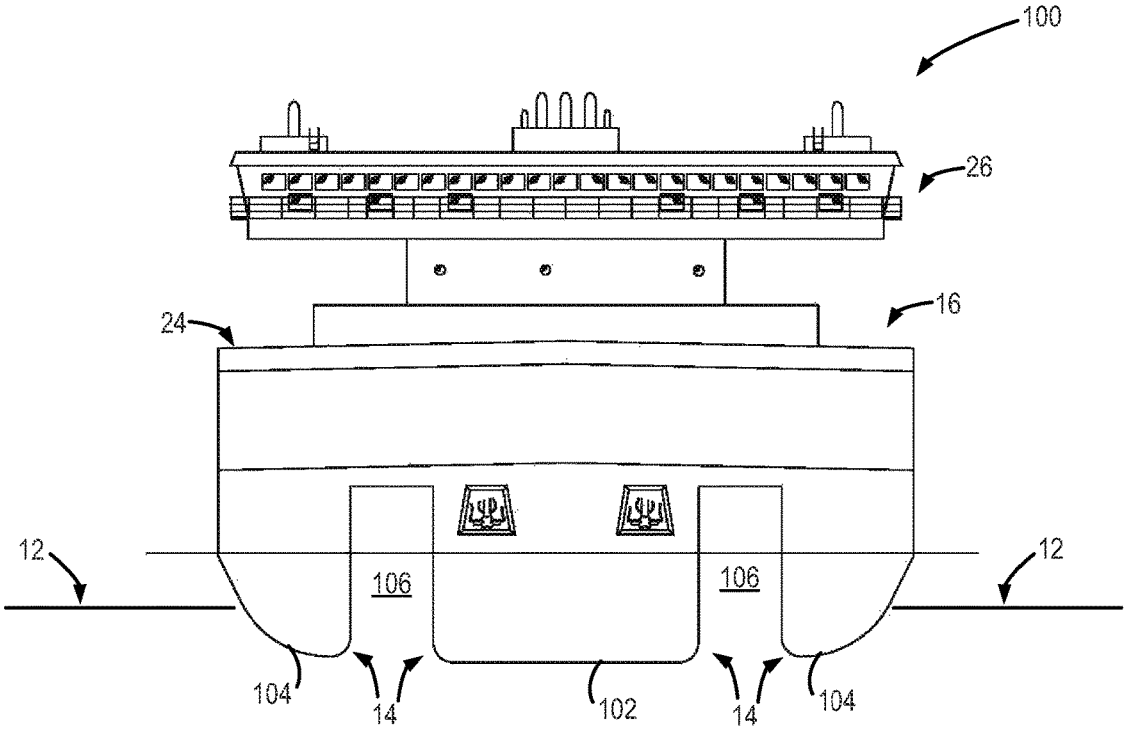
FIG. 12 is a front view of the wide beam, multi-hull icebreaker vessel of FIG. 9.

As best shown in FIGS. 10-12, the multi-hull icebreaker 100 is constructed such that the hulls 14 are spaced apart a distance that provides a beam 28 of the icebreaker 100 that is as wide as the beam of a large, state-of-the-art commercial vessel it is servicing (see FIG. 17). According to an exemplary embodiment, the hulls 14 are spaced apart a distance such that the beam 28 of icebreaker 100 is approximately 105 feet (with a length of the icebreaker 10 being 280 feet, for example)—with the beam 28 of the icebreaker 100 thus being of comparable size to the beam of the commercial vessel it is servicing, with such commercial vessels being constructed to have a beam 105 feet in size and a length of up to 1,000 feet. Accordingly, the wide-beam, multi-hull icebreaker 100 is constructed to break a track of sufficient width to accommodate commercial vessels of increased size and width.

As shown in FIG. 10, each hull 14 of icebreaker 100 has sides 30 and a bow portion 32. In one embodiment, the sides 30 are smooth to allow for the curvature of the hull 14 and the bow 32 is formed with a stem line 34 (FIG. 9) that provides for riding up on the ice and breaking it downward and under the hull. According to an exemplary embodiment, the bow 32 of each of the two outer hulls 104 is an asymmetric bow while the bow of the inner hull 102 is a symmetrical bow. The asymmetric bow of each of the outer hulls 104 has an inboard side 38 and an outboard side 40. The outboard side 40 of the bow 32 on each outer hull 104 is curved such that ice pushed down by the stem line 34 of the hull 104 is caused to slide along the sloped bow to the bottom. The inboard side 38 of the bow 32 on each outer hull 104 is formed as a straight side, so as to prevent increased ice loads on each inboard side 38 in a channel 106 between the respective outer hull 104 and the inner hull 102, which would occur if broken ice were funneled into the channels 106 between the outer hulls 104 and the inner hull 102, thereby preventing an unmanageable build-up of broken ice within the channels 106.

Figure 9:
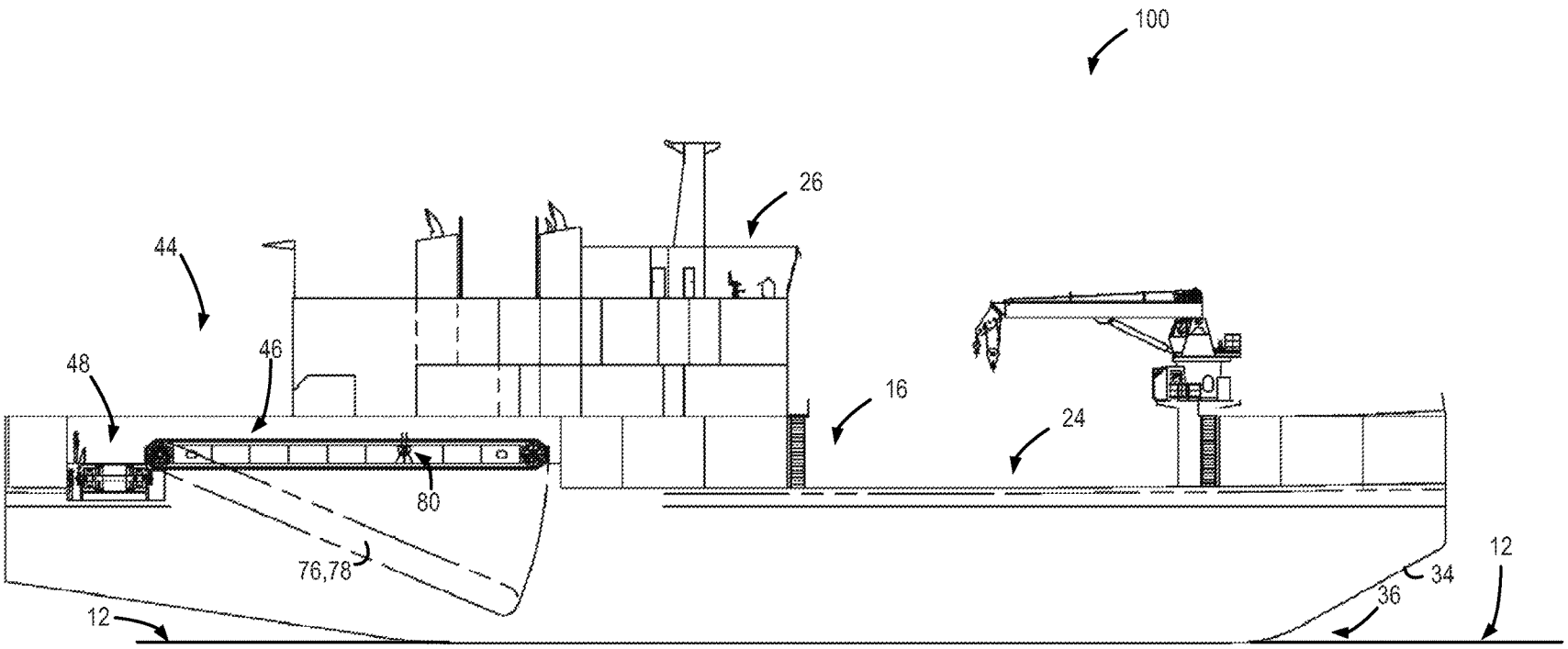
FIG. 9 is a side view of a trimaran-type wide beam, multi-hull icebreaker vessel, according to an embodiment of the invention.

Also included on the multi-hull icebreaker 100 is a conveyor system 44 that is positioned and configured to provide for removal of broken ice that enters into the channels 106—with the conveyor system 44 functioning to remove the broken ice from the channels 106 and transfer the broken ice to a region outside of the track formed by the multi-hull icebreaker 100. As best shown in FIG. 11, the conveyor system 44 includes a longitudinal conveyor 46 positioned in each channel 106 of the trimaran icebreaker 100 and a pair of horizontal conveyors ("shuttle conveyors") 48—each of which functions with a respective longitudinal conveyor 46 and is positioned adjacent one end of the longitudinal conveyor and oriented transverse thereto. As can be seen in FIG. 9, the longitudinal conveyors 46 are pivotable between a generally horizontal stowed position and an angled position—with each longitudinal conveyor 46 being positioned so as to be above the water line 36 when in the generally horizontal stowed position and the longitudinal conveyor 46 being positioned to angle downward from the bridging structure 16 into and below the water line 36 when in the angled position, such that broken ice may be guided onto the longitudinal conveyor 46. The shuttle conveyors 48 may, in an exemplary embodiment, be positioned on or below deck 24 at the end of the longitudinal conveyors 46 opposite the end that is lowered into the water, with the shuttle conveyors 48 extending out transverse from their respective longitudinal conveyors 46 in opposing directions so as to extend out to opposites sides 30 of the icebreaker 100 to cast the ice outward off both sides of the icebreaker. In this manner, broken ice that enters into channels 106 between hulls 14 may be removed from the channel and transferred to regions outside of the track in the ice formed by the multi-hull icebreaker 100 via the conveyor system 44.

Figure 13:
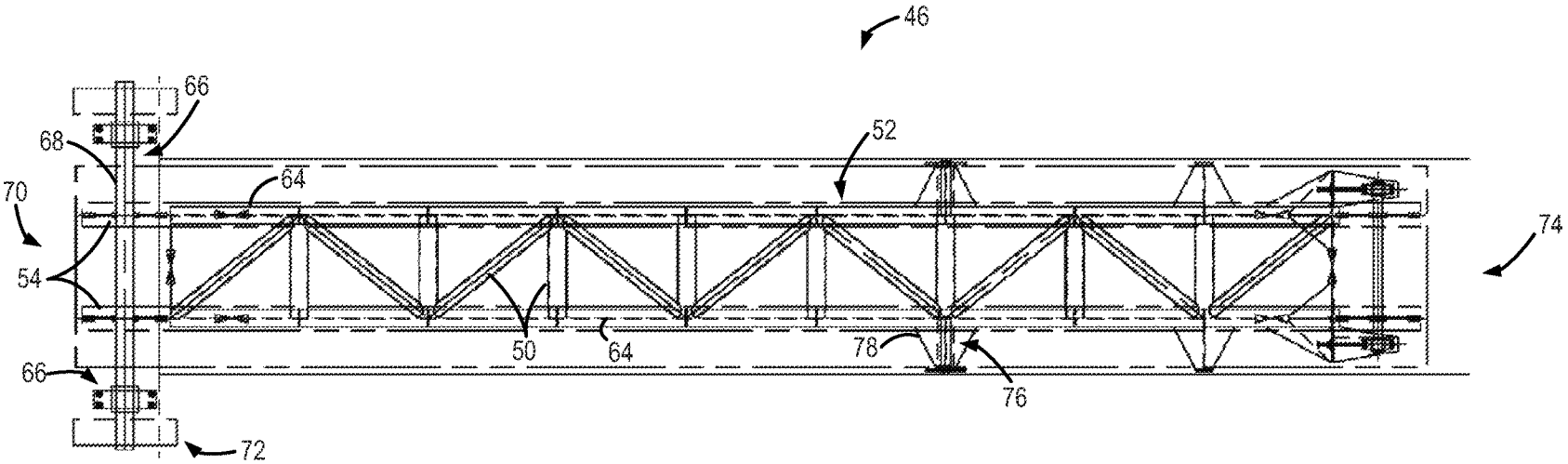
FIGS. 13 and 14 are top and side views of a longitudinal conveyor included in the wide beam, multi-hull icebreaker vessel of FIG. 9.
Figure 14:
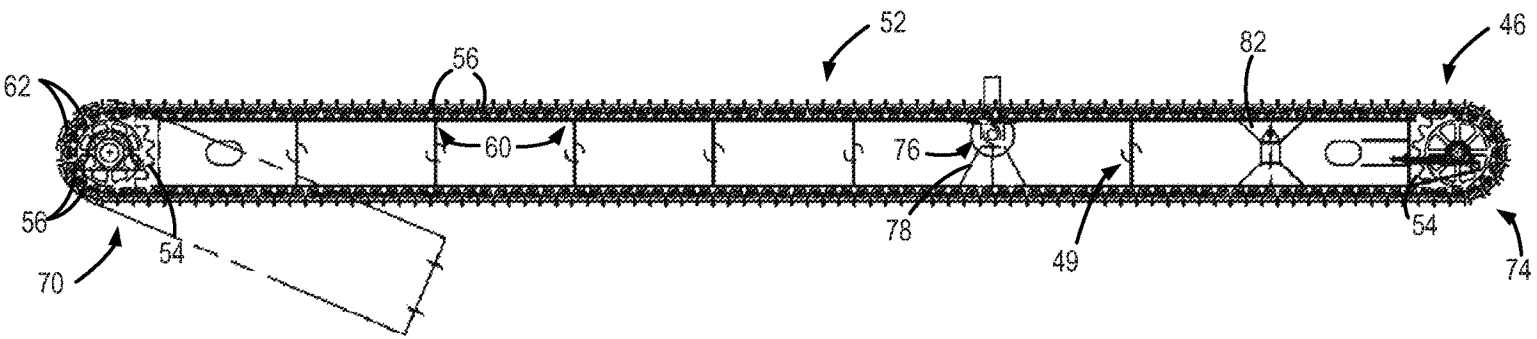

As shown in FIGS. 13 and 14, each of the longitudinal conveyors 46 may be of similar or identical in construction to that shown and described in FIGS. 5 and 6—although it is recognized that the width of each longitudinal conveyor 46 in the trimaran icebreaker 100 may be reduced as compared to the longitudinal conveyor 46 in the catamaran icebreaker 100 (e.g., 12 feet in width vs. 24 feet in width) based on the fact that two longitudinal conveyors 46 are included in the trimaran icebreaker 100 that are each required to convey and remove less broken ice thereon (due to the reduced width of channels 106 versus channel 42. Accordingly, the particular elements of the trimaran longitudinal conveyors 46 are numbered identically to corresponding elements of the catamaran longitudinal conveyor 46 shown in FIGS. 5 and 6 and are not described in detail here.

Figure 15:
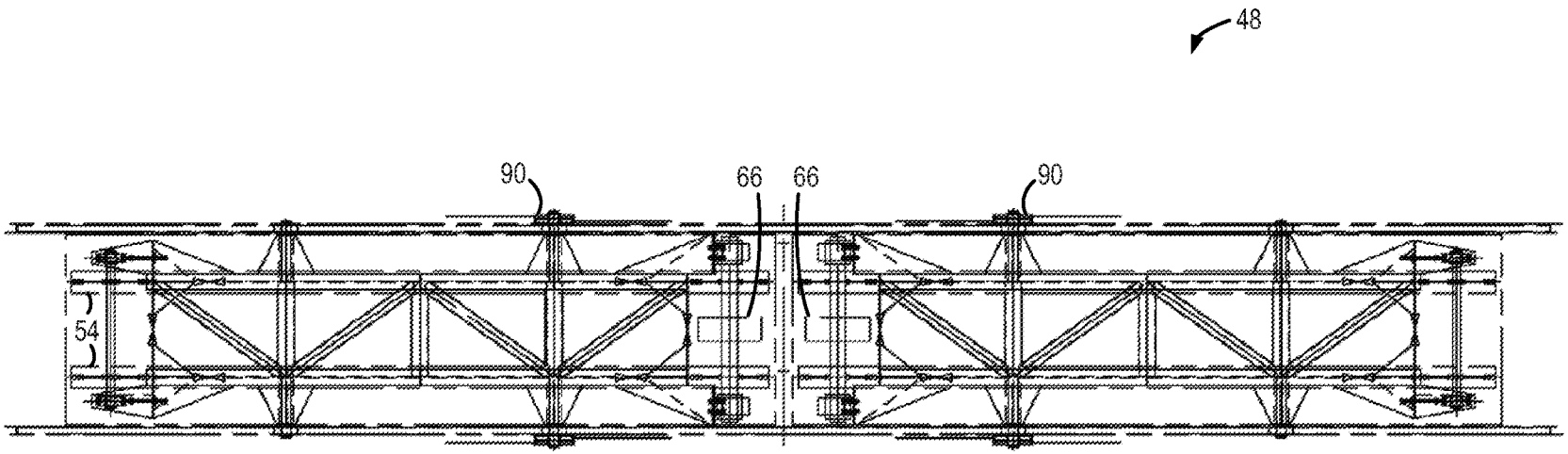
FIGS. 15 and 16 are top and side views of a shuttle conveyor included in the wide beam, multi-hull icebreaker vessel of FIG. 9.
Figure 16:
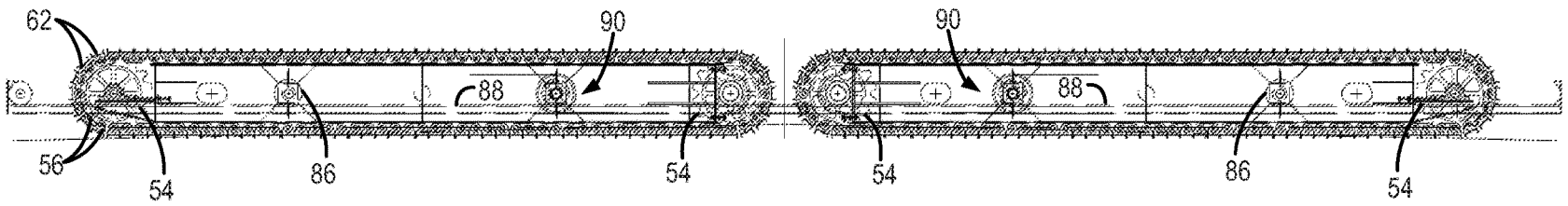

Referring now to FIGS. 15 and 16, the horizontal shuttle conveyors 48 are shown in greater detail. The shuttle conveyors 48 are similar in construction to the shuttle conveyor 48 shown and described in FIGS. 7 and 8 and thus the particular elements of the trimaran shuttle conveyors 48 are numbered identically to corresponding elements of the catamaran shuttle conveyor 48 shown in FIGS. 7 and 8 and are not described in detail here. However, as can be seen in FIGS. 15 and 16, the horizontal shuttle conveyors 48 of the trimaran icebreaker 100 are in the form of two separate shuttle conveyors that function with their respective longitudinal conveyor 46 to cast broken ice received thereby outward to its respective side of the icebreaker 100. Accordingly, rather than having a reversible/bidirectional functionality as the horizontal shuttle conveyor 48 of FIGS. 7 and 8, the shuttle conveyors 48 are configured as unidirectional conveyors that move in opposite directions to move the broken ice off of both sides of the icebreaker 100 and out from the track formed thereby. Each of the shuttle conveyors 48 is stowed within the beam 14 of the icebreaker vessel 100 (see FIG. 11) and can be traversed out to either side 30 of the vessel by a translation mechanism 90, such as a wire rope and winch or hydraulic cylinder(s), with rollers 86 of the conveyors rolling on fixed rail 88 to provide such traversing.

Beneficially, embodiments of the invention thus provide a wide beam, multi-hull icebreaker—in the form of a catamaran or trimaran type icebreaker—designed to break wide track through which large commercial vessels may traverse, with an open space between the hulls through which broken ice and slush ice is removed to reduce the amount of broken ice in the track. FIG. 17 illustrates icebreakers 10, 100 that form a track 110 having a width that is approximately equal to the beam of the commercial vessel 112. A conveyor system 44 is included on the icebreakers 10, 100 to provide an option for the removal of broken ice and slush ice from between the hulls to leave a less dense track of broken ice that is easier to maintain. Accordingly, icebreakers 10, 100 function to break a track of sufficient beam width that prevents the shoulder of a commercial vessel from striking unbroken ice that would impede its progress and/or cause structural damage thereto and that reduces the amount of broken or slush ice from adding friction to the hull of the commercial vessel and potentially clogging the water inlet thereof.

Therefore, according to one embodiment, a wide beam, multi-hull icebreaker includes a plurality of hulls spaced apart and arranged generally in parallel to one another, each of the plurality of hulls comprising a bow thereon configured to break through a sheet of ice through which the wide beam, multi-hull icebreaker traverses. The wide beam, multi-hull icebreaker also includes a bridging structure connecting the plurality of hulls. The plurality of spaced apart hulls define at least one channel therebetween into which at least of portion of ice broken by the hulls is routed, and the plurality of hulls are spaced apart a distance such that a beam of the wide beam, multi-hull icebreaker is as wide as a beam of a commercial vessel it is servicing.

According to another embodiment, a wide beam, multi-hull icebreaker includes a plurality of hulls spaced apart and arranged generally in parallel to one another and a bridging structure connecting the plurality of hulls. Each of the plurality of hulls includes a bow thereon configured to break through a sheet of ice through which the wide beam, multi-hull icebreaker traverses, and the plurality of spaced apart hulls define at least one channel therebetween into which at least of portion of ice broken by the hulls is routed. The wide beam, multi-hull icebreaker also includes a conveyor system positioned and configured to remove ice from the at least one channel and convey it to a region outside of a track in the ice formed by the wide beam, multi-hull icebreaker.

According to yet another embodiment, a method of assisting a wide beam vessel through an ice field includes providing a wide-beam, multi-hull icebreaker having a plurality of hulls spaced apart and arranged generally in parallel to one another, each of the plurality of hulls comprising a bow thereon configured to break through a sheet of ice through which the wide beam, multi-hull icebreaker traverses, wherein the plurality of spaced apart hulls define at least one channel therebetween. The method also includes advancing the wide-beam, multi-hull icebreaker through the ice field to form a track of broken ice in the ice field through which the wide beam vessel can pass, with the plurality of hulls being spaced apart a distance such that a beam of the wide beam, multi-hull icebreaker is as wide as a beam of the wide beam vessel it is assisting, such that a width of the track of broken ice in the ice field is essentially the same width as the wide beam vessel.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A wide beam, multi-hull icebreaker comprising:

a plurality of hulls spaced apart and arranged generally in parallel to one another, each of the plurality of hulls comprising a bow thereon configured to ride up on a sheet of ice through which the wide beam, multi-hull icebreaker traverses and break the sheet of ice via a weight of the icebreaker pushing down thereon; and a bridging structure connecting the plurality of hulls;

wherein the plurality of spaced apart hulls define at least one channel therebetween into which at least of portion of ice broken by the hulls is routed; and wherein the plurality of hulls are spaced apart a distance such that a beam of the wide beam, multi-hull icebreaker is as wide as a beam of a commercial vessel it is servicing.

2. The wide beam, multi-hull icebreaker of claim 1 further comprising a conveyor system positioned and configured to remove ice from the at least one channel and convey it to a region outside of a track in the ice formed by the wide beam, multi-hull icebreaker.

3. The wide beam, multi-hull icebreaker of claim 2 wherein the conveyor system comprises a longitudinal conveyor positioned in each respective channel of the at least one channel, the longitudinal conveyor being pivotable between a generally horizontal stowed position and an angled position;

wherein, when in the angled position, the longitudinal conveyor is angled downward from the bridging structure into and below a water line of a body of water on which the wide beam, multi-hull icebreaker is operating; and wherein, when in the generally horizontal stowed position, the longitudinal conveyor is positioned and stowed so as to be above the water line.

4. The wide beam, multi-hull icebreaker of claim 2 wherein the longitudinal conveyor comprises:

a conveyor belt formed of transverse metal bars or shapes arranged to convey ice therealong, the conveyor belt supported by an internal open structure and maintained in place by connecting links that space the metal bars or shapes;

sprockets positioned at each end of the internal open structure, the sprockets being engaged to shafts that pin the connecting links on the metal bars or shapes together; and a drive unit positioned at at least one end of the longitudinal conveyor to drive the sprockets positioned thereat, so as to cause translation of the conveyor belt and convey ice therealong.

5. The wide beam, multi-hull icebreaker of claim 4 wherein a minimum speed at which the drive unit drives the conveyor belt is equal to a speed of the icebreaker divided by the cosine of the angle of the inclined longitudinal conveyor belt from the horizontal.

6. The wide beam, multi-hull icebreaker of claim 3 wherein a first end of the longitudinal conveyor is pivotably coupled to the bridging structure by way of bearings fixed to the bridging structure; and wherein a second end of the longitudinal conveyor includes pivots and a rigging thereon, the pivots and the rigging interacting with a actuating mechanism to raise and lower the second end of the longitudinal conveyor to selectively move the longitudinal conveyor between the generally horizontal stowed position and the angled position.

7. The wide beam, multi-hull icebreaker of claim 6 further comprising a fixed structural stop positioned to support the second end of the longitudinal conveyor when the longitudinal conveyor is in the generally horizontal stowed position.

8. The wide beam, multi-hull icebreaker of claim 3 wherein the conveyor system further includes a shuttle conveyor oriented transverse to the longitudinal conveyor and positioned adjacent the first end of the longitudinal conveyor, the shuttle conveyor extending out transverse from the longitudinal conveyor in at least one direction and extending out to at least one side of the vessel to cast the ice outward to a region outside of the track in the ice formed by the wide beam, multi-hull icebreaker.

9. The wide beam, multi-hull icebreaker of claim 8 the shuttle conveyor comprising:

a main frame comprising beams cantilevered with rollers;

a conveyor positioned on the main frame and configured to convey ice therealong; and fixed skirts positioned on the structure to contain the ice on the conveyor;

wherein the main frame is positioned on a fixed rail attached to the structure, such that the shuttle conveyor may be translated along the fixed rail.

10. The wide beam, multi-hull icebreaker of claim 2 further comprising fixed or portable hot water or steam nozzles positioned to eject hot water or steam onto the conveyor system, so as to prevent excessive buildup of ice thereon in freezing temperatures.

11. The wide beam, multi-hull icebreaker of claim 1 wherein the plurality of hulls comprises two hulls, such that the wide beam, multi-hull icebreaker comprises a catamaran icebreaker.

12. The wide beam, multi-hull icebreaker of claim 11 wherein the bow of each of the two hulls comprises an asymmetrical bow having inboard and outboard sides, and wherein the inboard side of the bow on each of the two hulls is formed as a straight side, such that inboard sides of the bows on the two hulls are parallel to one another.

13. The wide beam, multi-hull icebreaker of claim 1 wherein the plurality of hulls comprises three hulls composed of an inner hull and two outer hulls, such that the wide beam, multi-hull icebreaker comprises a trimaran icebreaker.

14. The wide beam, multi-hull icebreaker of claim 13 wherein the bow of each of the two outer hulls comprises an asymmetrical bow having inboard and outboard sides, and wherein the inboard side of the bow on each of the two hulls is formed as a straight side, such that inboard sides of the bows on the two hulls are parallel to one another; and wherein the bow of the inner hull comprises a symmetrical bow.

15. The wide beam, multi-hull icebreaker of claim 13 wherein the beam of the wide beam, multi-hull icebreaker is approximately 105 feet.

16. A wide beam, multi-hull icebreaker comprising:

a plurality of hulls spaced apart and arranged generally in parallel to one another, each of the plurality of hulls comprising a bow thereon configured to break through a sheet of ice through which the wide beam, multi-hull icebreaker traverses, and wherein the plurality of spaced apart hulls define at least one channel therebetween into which at least of portion of ice broken by the hulls is routed;

a bridging structure connecting the plurality of hulls; and a conveyor system positioned and configured to remove ice from the at least one channel and convey it to a region outside of a track in the ice formed by the wide beam, multi-hull icebreaker.

17. The wide beam, multi-hull icebreaker of claim 16 wherein the conveyor system comprises a longitudinal conveyor positioned in each respective channel of the at least one channel, the longitudinal conveyor being pivotable between a generally horizontal stowed position and an angled position;

wherein, when in the angled position, the longitudinal conveyor is angled downward from the bridging structure into and below a water line of a body of water on which the wide beam, multi-hull icebreaker is operating; and wherein, when in the generally horizontal stowed position, the longitudinal conveyor is positioned and stowed so as to be above the water line.

18. The wide beam, multi-hull icebreaker of claim 16 wherein the conveyor system further includes a shuttle conveyor oriented transverse to the longitudinal conveyor and positioned adjacent the first end of the longitudinal conveyor, the shuttle conveyor extending out transverse from the longitudinal conveyor in at least one direction and extending out to at least one side of the vessel to cast the ice outward to a region outside of the track in the ice formed by the wide beam, multi-hull icebreaker.

19. The wide beam, multi-hull icebreaker of claim 16 wherein the plurality of hulls comprises either:

two hulls, such that the wide beam, multi-hull icebreaker comprises a catamaran icebreaker; or three hulls, such that the wide beam, multi-hull icebreaker comprises a trimaran icebreaker.

20. The wide beam, multi-hull icebreaker of claim 19 wherein an outermost hull of the plurality of hulls on each side of the wide beam, multi-hull icebreaker includes an asymmetrical bow having inboard and outboard sides, and wherein the inboard side of the bow on each of the outermost hulls is formed as a straight side, such that inboard sides of the bows on the two hulls are parallel to one another.

21. A method of assisting a wide beam vessel through an ice field, the method comprising:

providing a wide-beam, multi-hull icebreaker comprising a plurality of hulls spaced apart and arranged generally in parallel to one another, each of the plurality of hulls comprising a bow thereon configured to break through a sheet of ice through which the wide beam, multi-hull icebreaker traverses, wherein the plurality of spaced apart hulls define at least one channel therebetween; and advancing the wide-beam, multi-hull icebreaker through the ice field to form a track of broken ice in the ice field through which the wide beam vessel can pass;

wherein the plurality of hulls are spaced apart a distance such that a beam of the wide beam, multi-hull icebreaker is as wide as a beam of the wide beam vessel it is assisting, such that a width of the track of broken ice in the ice field is essentially the same width as the wide beam vessel.

22. The method of claim 21 wherein, in advancing the wide-beam, multi-hull icebreaker through the ice field to form a track of broken ice in the ice field, the method further comprises:

routing at least a portion of ice broken by the hulls into the at least one channel defined by the plurality of hulls; and operating a conveyor system of the wide-beam, multi-hull icebreaker to permit removal of the ice routed into the at least one channel and convey it off of at least one side of the wide-beam, multi-hull icebreaker to a region outside of the track.

* * * * *